US007439520B2

(12) United States Patent
Vestal

(10) Patent No.: US 7,439,520 B2
(45) Date of Patent: Oct. 21, 2008

(54) ION OPTICS SYSTEMS

(75) Inventor: Marvin L. Vestal, Framingham, MA (US)

(73) Assignee: Applied Biosystems Inc., Foster City, CA (US)

( * ) Notice: Subject to any disclaimer, the term of this patent is extended or adjusted under 35 U.S.C. 154(b) by 86 days.

(21) Appl. No.: 11/042,191

(22) Filed: Jan. 24, 2005

(65) Prior Publication Data

US 2006/0163473 A1 Jul. 27, 2006

(51) Int. Cl.
*H01J 49/00* (2006.01)
*H01J 49/48* (2006.01)

(52) U.S. Cl. ..... 250/396 ML; 250/396 R; 250/305

(58) Field of Classification Search ..... 250/396 ML
See application file for complete search history.

(56) References Cited

U.S. PATENT DOCUMENTS 4,418,280 A * 11/1983 Matsuda ..... 250/296
5,126,565 A * 6/1992 Rose ..... 250/305
5,128,543 A 7/1992 Reed et al.
5,202,563 A 4/1993 Cotter et al.
5,449,914 A * 9/1995 Rose et al. ..... 250/396 ML
5,637,879 A 6/1997 Schueler
5,955,730 A 9/1999 Kerley et al.
6,013,913 A 1/2000 Hanson
6,274,866 B1 8/2001 Li
6,365,892 B1 4/2002 Cotter et al.
6,469,295 B1 10/2002 Park
6,489,610 B1 12/2002 Barofsky et al.
6,580,070 B2 6/2003 Cornish et al.

OTHER PUBLICATIONS

Hohl, et al. "Mass selective blanking in a compact multiple reflection time-of-flight mass spectrometer." *International Journal of Mass Spectrometry* 188 (1999):189-197.

Kim, et al. "High-resolution ion time-of-flight analysis for measuring molecular velocity distributions." Review of Scientific Instruments, vol. 74, No. 11 (2003):4805-4811.

Matsuda, H., et al. "Potential Distribution in a Cylindrical Condenser Terminated by Matsuda Plates." *International Journal of Mass Spectrometry and Ion Physics*, 19 (1975):395-404.

Matsuda, Hisashi, "Electrostatic Analyzer with Variable Focal Length." *The Review of Scientific Instruments*, vol. 32, No. 7 (1961):850-852.

(Continued)

*Primary Examiner*—David A. Vanore
(74) *Attorney, Agent, or Firm*—Ropes & Gray LLP

(57) ABSTRACT

In various embodiments, provided are ion optics systems comprising two or more pairs of ion condensers arranged where the first member and second member of each pair are disposed on opposite sides of a first plane such that the first member of the pair has a position that is substantially mirror-symmetric about the first plane relative to the position of the second member of the pair and wherein the deflection angle of each of the ion condensers is less than or equal to about π radians.

19 Claims, 8 Drawing Sheets

OTHER PUBLICATIONS

Poschenrieder, W.P. "Multiple-Focusing Time-of-Flight Mass Spectrometers Part II TOFMS with Equal Energy Acceleration." *International Journal of Mass Spectrometry and Ion Physics*, 9 (1972):357-373.

Sakurai, T., et al. "A New Time-of-Flight Mass Spectrometer." *International Journal of Mass Spectrometry and Ion Processes*, 66 (1985):283-290.

Sakurai, Toru, et al. "MS/MS and MS/MS/MS Analyses in a Multisector Time-of-Flight Mass Spectrometer." *Analytical Chemistry*, vol. 66, No. 14, (1994):2313-2317.

Wollnik, Hermann, "Ion Optics in Mass Spectrometers." *Journal of Mass Spectrometry*, 34:991-1006 (1999).

* cited by examiner

ION OPTICS SYSTEMS

INTRODUCTION

Time-of-flight (TOF) mass spectrometry (MS) has become a widely used analytical technique. Two important metrics of mass spectrometry instrumentation performance are resolving power and sensitivity. In mass spectrometry, the mass resolving power of a measurement is related to the ability to separate ions of differing mass-to-charge ratio (m/z) values. The sensitivity of a mass spectrometry instrument is related to the efficiency of ion transmission from source to detector, and the efficiency of ion detection. In various mass spectrometers, including TOF instruments, it is possible to improve the resolving power at the expense of sensitivity, and vice versa.

There are several aspects of TOF MS that can inherently limit the resolution of a TOF mass analyzer. Specifically, ions can be formed in the source region at different times, at different positions, and with different initial velocities. These spreads in ion formation time, position and velocity can result in some ions with the same m/z achieving different kinetic energies (and some ions with different m/z achieving the same kinetic energy) due to differences in the length of time they spend in the extracting electrical field, differences in the strength of the electrical field where they are formed, and/or different initial kinetic energies. As a result, the resolving power and performance of the TOF mass spectrometer instrument can be degraded.

The mass resolving power of a mass spectrometer may be expressed as a ratio m/δm, where m is the mass of a particular singly charged ion and /δm is the width of the peak in mass units. In traditional TOF instruments, ions are separated according to their flight time, t, to a detector, and in most cases the mass/charge ratio is proportional to the square of the flight time. Thus, the resolving power, R, can be expressed as, $$R=m/\delta m, \text{ and as}$$

$$R=t/2\delta t$$

in a TOF instrument.

In a simple linear TOF instrument comprising an ion source where the ions are formed and accelerated to a final energy that is substantially independent of the m/z ratio of the ions, the flight time is proportional to the effective flight distance, inversely proportional to the square root of the ion energy, and directly proportional to the square root of the mass/charge ratio. Any variation in the kinetic energy or effective flight distance for an ion of a particular m/z causes a variation in the flight time and corresponding reduction in resolving power.

In many cases a major factor limiting resolving power can be the spread in kinetic energy of the ions. In these cases an ion mirror is often employed to compensate for, to first or second order, the effect of kinetic energy on flight time, thereby improving the resolving power of the TOF instrument. One property of prior art ion mirrors, however, is that they produce energy dispersion whereby ions of differing kinetic energies may be time focused at a particular focal plane, but are displaced in a direction parallel to the plane according to their kinetic energies. In many applications this may not be a problem, but in others it can limit both the resolving power and the sensitivity of the mass analyzer. For example, in a single stage TOF instrument this energy dispersion can cause ions of different kinetic energies to strike different spots on the detector, but if the detector is sufficiently large, and the plane of the detector is accurately aligned with the focal plane, then no loss in either resolving power or sensitivity substantially occurs. However, applications where the ion mirror is used in the first stage of a TOF-TOF system, energy dispersion in the first stage can cause significant losses in both sensitivity and resolving power in the second stage of the instrument.

SUMMARY

The present teachings relate to ion optics systems for mass analyzer systems.

An ion condenser can be used to focus ions from a first focal plane (an object plane) to a second focal plane (an image plane) such that ions at the first focal plane reach the second focal plane at substantially the same time despite differences in kinetic energy that existed between these ions at the first focal plane. Herein we refer to the process whereby an ion condenser can be used to bring ions with different kinetic energies to a particular plane in space at substantially the same time as "energy focusing." However, although ions can be made to arrive substantially simultaneously at an image plane despite differences in kinetic energy between them at the object plane, ions with differing kinetic energy do not arrive at the same spatial location on the image plane. Rather, the exit trajectories of ions with different kinetic energy intersect the image plane (or a plane substantially parallel to the image plane) at different spatial locations, which are typically laterally dispersed across such a plane. This process has been referred to as "energy dispersion" because, for example, it refers to a spatial dispersion of the ion trajectories that is due to differences in ion kinetic energy.

The skilled artisan will recognize that the concepts described herein using the terms energy dispersion, energy focusing, object plane and image plane can be described using different terms. As an ion condenser can be used to bring ions with different kinetic energies to a particular plane in space at substantially the same time, this process has been referred to by several terms in the art including, "energy focusing," "time focusing" and "temporal focusing." In addition, for example, the terms "space focus," "space focus plane," "space focal plane," "time focus," and "time focus plane" have all been used in the art to refer to one or more of what are referred to herein as the object plane and image plane. Unfortunately, the terms "energy focusing," "time focusing," "temporal focusing," "space focus," "space focus plane," "space focal plane," "time focus," and "time focus plane" have also been used in the art of time-of-flight mass spectrometry to describe processes that are fundamentally different from the energy focusing of an ion condenser. Accordingly, given the complex usage of terminology found in the mass spectrometry art, the terms "energy dispersion," "energy focusing," "object plane" and "image plane" used herein were chosen for conciseness and consistency in explanation only and should not be construed out of the context of the present teachings to limit the subject matter described in any way.

The present teachings provide ion optics systems comprising two or more pairs of ion condensers arranged where the first member and second member of each pair are disposed on opposite sides of a first plane such that the first member of the pair has a position that is substantially mirror-symmetric about the first plane relative to the position of the second member of the pair, and where the deflection angle, θ, for each ion condenser is less than or equal to about π radians. In various embodiments, the present teachings provide ion optics systems that can provide energy focusing of ions with substantially no spatial dispersion due to differences in kinetic energy the ions may have had on entering the ion optics system. It is to be understood that differences in ion kinetic energy due to other processes that might arise after ions enter the ion optics system (e.g., including, but not limited to, space charge effects, ion fragmentation, etc.) are not considered by the present teachings to be differences in kinetic energy the ions have on entering the ion optics system. In various embodiments, the ion optic systems provide an ion trajectory exiting the ion optics system that is substantially parallel to the corresponding ion trajectory entering the ion optics system. In various embodiments, the ion condensers can be arranged such that the ion trajectory exiting the ion optics system is substantially coincident with the corresponding ion trajectory entering the ion optics system. The ion optic systems of the present teachings can include, for example, one or more ion-focusing elements (e.g., an einzel lens), and ion-steering elements (e.g., deflector plates), for example, to provide a substantially parallel input ion beam.

In various aspects, provided are ion optics systems, comprising four or more ion condensers each with a deflection angle, $\theta$, less than or equal to about $\pi$ radians, where a parallel input ion beam yields a substantially parallel output ion beam with no magnification and where the transit time through the condenser is independent of the displacement of an entering trajectory from the nominal axis.

In various aspects, the present teachings provide an ion optics system comprising two or more pairs of ion condensers where the members of each pair of ion condensers are disposed on opposite sides of a first plane such that the first member of a pair of ion condensers has a position that is substantially mirror-symmetric about the first plane relative to the position of the second member of the pair, and where the deflection angle, $\theta$, for each ion condenser is less than or equal to about $\pi$ radians. In various embodiments, the ion condensers are arranged such that a trajectory of an ion exiting the ion optics system can be provided that intersects a surface substantially parallel to a focal surface of the ion optics system at a position that is substantially independent of ion kinetic energy.

In various aspects, the present teachings provide an ion optics system comprising four ion condensers where the first ion condenser and the second ion condenser are disposed on opposite sides of a first plane such that the first ion condenser has a position that is substantially mirror-symmetric about the first plane relative to the position of the second ion condenser and where the third ion condenser and the fourth ion condenser are disposed on opposite sides of the first plane such that the third ion condenser has a position that is substantially mirror-symmetric about the first plane relative to the position of the fourth ion condenser, and where the deflection angle, $\theta$, for each ion condenser is less than or equal to about $\pi$ radians. In various embodiments, the ion condensers are arranged such that a trajectory of an ion exiting the fourth ion condenser can be provided that intersects a surface substantially parallel to a focal surface of the fourth ion condenser at a position that is substantially independent of ion kinetic energy.

In various embodiments of an ion optics system of the present teachings, the ion optics system comprises an ion selector. For example, in various embodiments, an ion optics system comprises two or more pairs of ion condensers where the members of each pair of ion condensers are disposed on opposite sides of a first plane such that the first member of a pair of ion condensers has a position that is substantially mirror-symmetric about the first plane relative to the position of the second member of the pair, each of the ion condensers having a deflection angle, $\theta$, less than or equal to about $\pi$ radians, and at least one ion selector positioned between two of the ion condensers, for example, to prevent the transmission of ions with select kinetic energies. Such placement can take advantage of the energy dispersion that can exist between ion condensers of the ion optics system. Suitable ion selectors include any structure that can prevent the transmission of ions based on ion position.

In the various embodiments, suitable ion condensers include, but are not limited to, spherical ion condensers, cylindrical ion condensers, and toroidal ion condensers. In various embodiments, the ion condensers comprise substantially 127.2° deflection angle cylindrical ion condensers. In various embodiments, the ion condensers comprise substantially 180° deflection angle spherical ion condensers.

In various aspects, the present teachings provide mass analyzer systems comprising an ion optics system of the present teachings and a mass analyzer. The ion optics system comprising two or more pairs of ion condensers where: the members of each pair of ion condensers are disposed on opposite sides of a first plane such that the first member of a pair of ion condensers has a position that is substantially mirror-symmetric about the first plane relative to the position of the second member of the pair; and where the deflection angle, $\theta$, for each ion condenser is less than or equal to about $\pi$ radians. In various embodiments, the ion condensers are arranged such that a trajectory of an ion exiting the ion optics system can be provided that intersects a surface substantially parallel to a focal surface of the ion optics system at a position that is substantially independent of ion kinetic energy. The mass analyzer can comprise, e.g., comprising at least one of a time-of-flight, ion trap, quadrupole, RF multipole, and ion mobility spectrometer.

In various embodiments, a mass analyzer system of the present teachings can further comprise one or more of an ion source, ion selector, ion fragmentor, and ion detector. The mass analyzer systems can further comprise one or more ion guides (e.g., RF multipole guide, guide wire), ion mirrors, ion-focusing elements (e.g., an einzel lens), and ion-steering elements (e.g., deflector plates). In various embodiments, the mass analyzer systems the present teaching can provide include, but are not limited to: a first time-of-flight (TOF) mass selector for a tandem TOF-TOF mass spectrometer system; and a TOF-TOF mass spectrometer system.

In various embodiments of a mass analyzer system, an ion fragmentor can be disposed between the ion optics system and the mass analyzer. The ion fragmentor is disposed, in some embodiments, such that the entrance to the ion fragmentor substantially coincides with the image surface (e.g., image plane) of the ion optics system. In some embodiments, ion fragmentor is disposed such that the exit of the ion fragmentor substantially coincides with a focal surface (e.g., an object focal surface) of the mass analyzer. In various embodiments, an ion selector can be disposed between two ion condensers of the ion optics system between two ion condensers to select, for example, the transmission of ions with select kinetic energies, and thereby select the range of ion kinetic energies transmitted by the ion optics system to the ion fragmentor. Accordingly, in various embodiments, the ion optics system selects a primary ion, with a kinetic energy in a selected energy range, for introduction into an ion fragmentor and the mass analyzer is configured to analyze at least a portion of the fragment ion spectrum.

In various embodiments, a mass analyzer system further comprises one or more ion selectors. In various embodiments, an ion selector is disposed between: the ion optics system and a mass analyzer, two ion condensers of the ion optics system to prevent the transmission of ions with select kinetic energies, or both. For example, in various embodiments, an ion selector is disposed between an ion optics system and a mass analyzer such that the location of the ion selector substantially coincides with the image surface (e.g., image plane) of the ion optics system. Suitable ion selectors include, e.g., timed-ion-selectors. In various embodiments, the trajectory of ions from the ion optics system is substantially coaxial with an axis of the ion selector. In some embodiments, the ion selector is energized to transmit only ions within a selected m/z range to, for example, an ion fragmentor disposed between the ion selector and the mass analyzer. Accordingly, in various embodiments, an ion selector selects a primary ion (from the ions transmitted by the ion optics system) for introduction into an ion fragmentor and a mass analyzer is configured to analyze at least a portion of the fragment ions.

In various embodiments of a mass analyzer system, first ion selector is positioned between two ion condensers of the ion optics system to prevent the transmission of ions with select kinetic energies and a second ion selector is positioned between the ion optics system and an ion fragmentor disposed between the ion optics system and a mass analyzer. Accordingly, in various embodiments, an ion optics system with a first ion selector selects ions with a kinetic energy in a selected energy range for transmittal, and the second ion selector selects a primary ion (e.g., a range of m/z values) for introduction into the ion fragmentor.

The foregoing and other aspects, embodiments, and features of the present teachings can be more fully understood from the following description in conjunction with the accompanying drawings. In the drawings like reference characters generally refer to like features and structural elements throughout the various figures. The drawings are not necessarily to scale, emphasis instead being placed upon illustrating the principles of the teachings.

BRIEF DESCRIPTION OF THE DRAWINGS

The skilled artisan will understand that the drawings, described herein, are for illustration purposes only. In the drawings the present teachings are illustrated using static electrical field ion condensers, but non-static electrical field ion condensers can be used. The drawings are not intended to limit the scope of the present teachings in any way.

DESCRIPTION OF VARIOUS EMBODIMENTS

To better understand the present teachings, examples of the behavior of ions in a single ion condenser and in two ion condensers in series are provided.

Single Ion Condenser

Figure 1A:
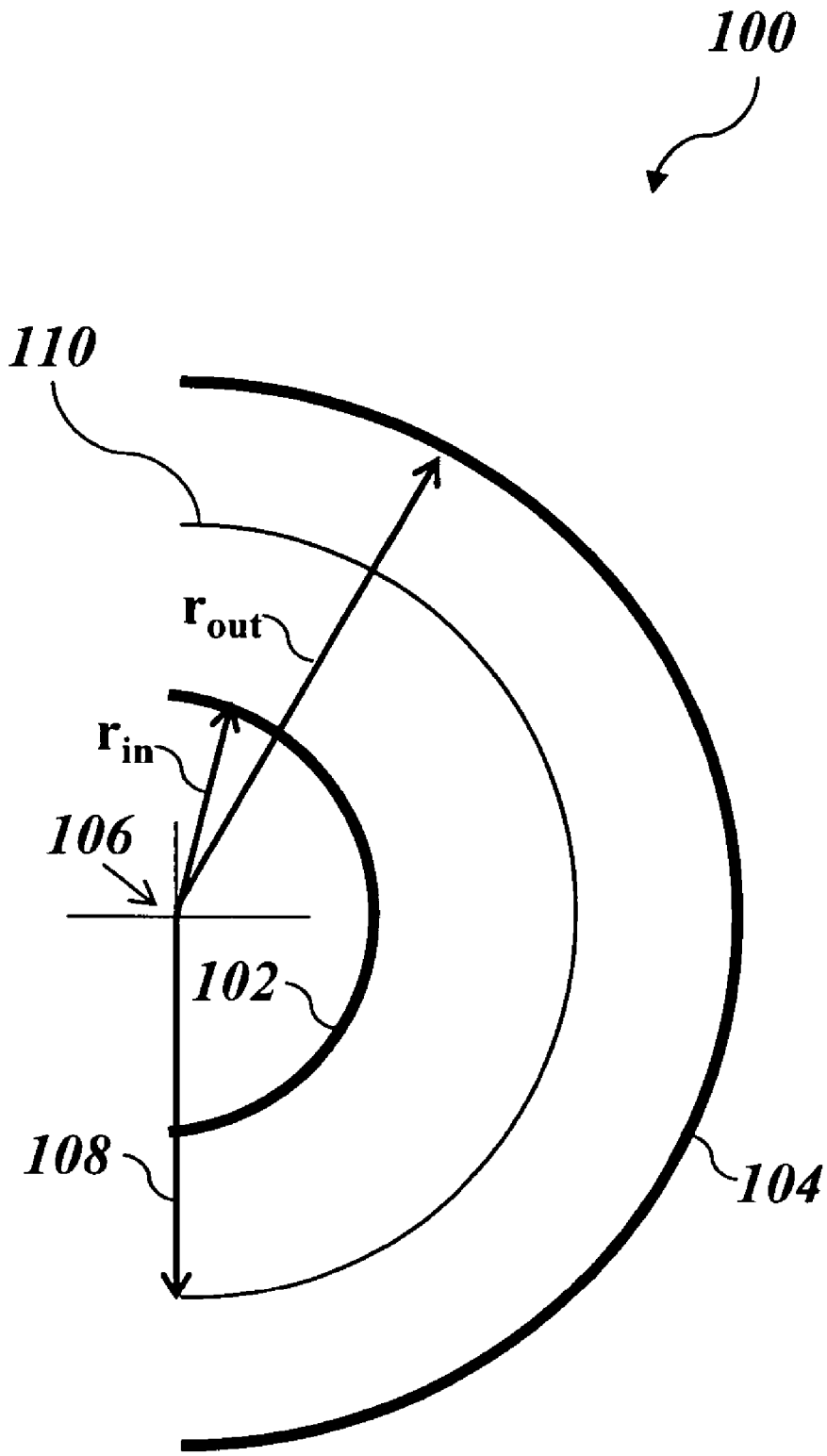
FIG. 1A schematically depicts a single spherical ion condenser and the representative nominal ion trajectory for ions that enter at $r_0$.
Figure 1B:
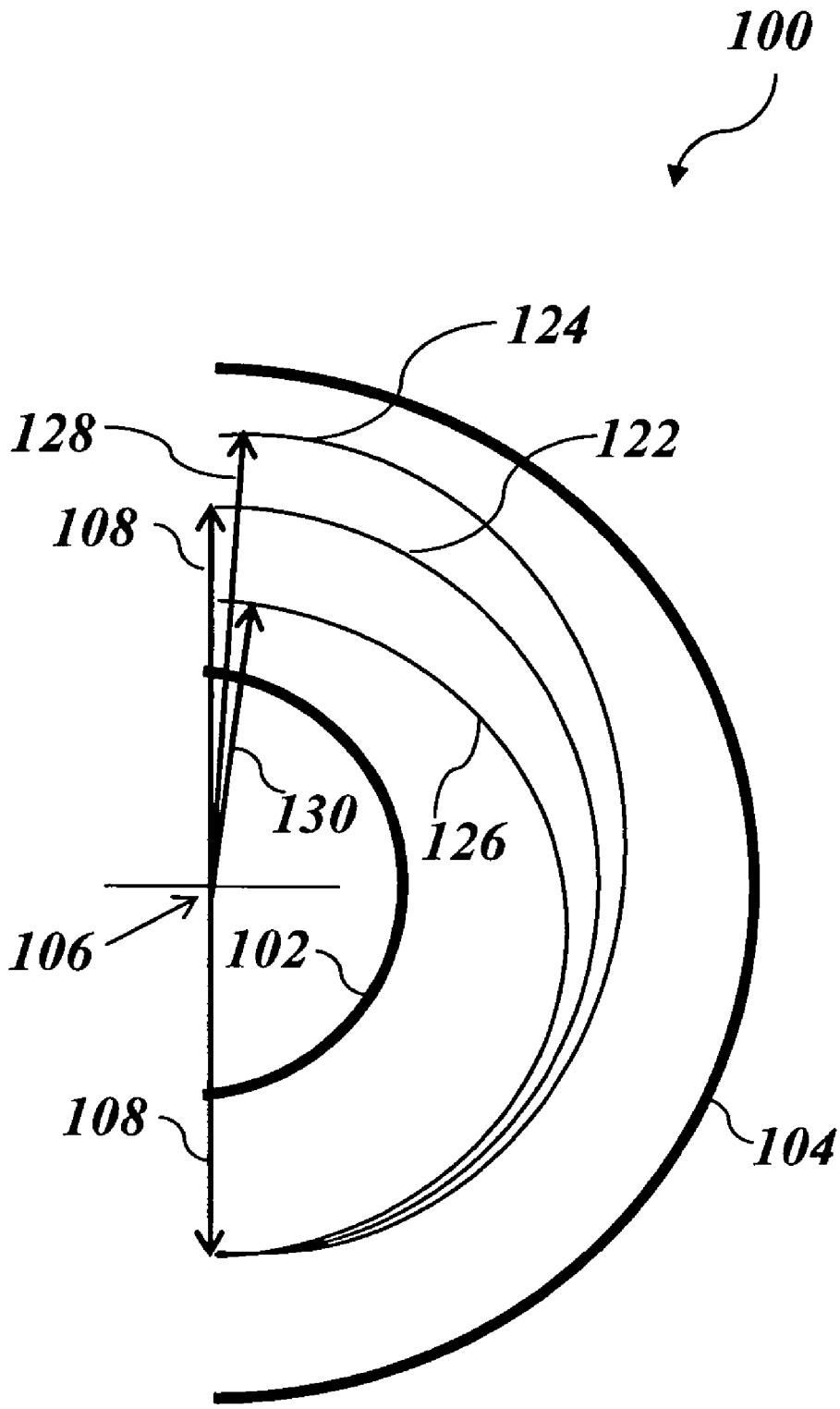
FIG. 1B schematically depicts the ion trajectories of ions with three different energies in the ion condenser of FIG. 1A.
Figure 1C:
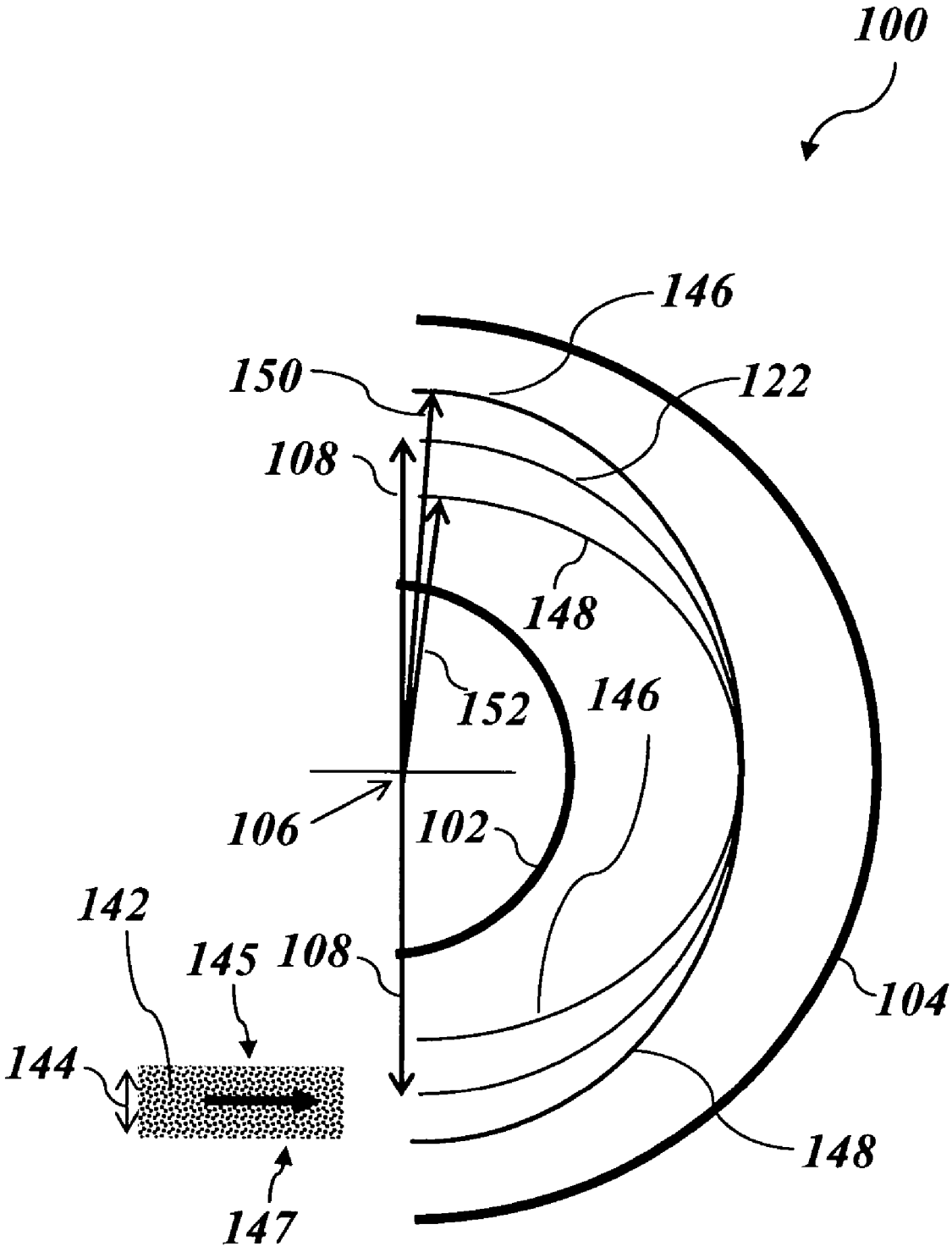
FIG. 1C schematically depicts the ion trajectories of ions with three different initial radial positions in the ion condenser of FIG. 1A.

To better understand the present teachings, an example of the behavior of ions in a single 180 degree spherical ion condenser employing a static electrical field is schematically illustrated in FIGS. 1A-1C. In a single spherical ion condenser 100, employing a static electrical field, ions enter the electrical field formed by a pair of hemispheric electrodes 102, 104. In this illustration, the ions are produced from an ion source at potential $V_0$ and, for convenience of notation and conciseness, the electrodes are considered to be biased so that ground or zero potential is at the nominal radius $r_0$. The angular momentum, l, and the total energy, E, are constants of the motion of an ion in an ion condenser and for a given set of initial conditions define the ion trajectory.

The angular momentum, l, of an ion about the center of force can be given by, $$l=mr(d\vartheta/dt) \quad (1),$$

where m represents the mass of the ion, and $d\vartheta/dt$ the change in angular position, $\vartheta$, with respect to time, t. The kinetic energy, T(r), of the ions can be given by, $$T(r)=E-V(r) \quad (2),$$

where E represents the total energy, and V(r) the potential energy at a distance r from the center of force 106. If the arbitrary choice for the reference or ground potential is taken as the equipotential surface at $r=r_0$, then the potential at any distance r is $$V(r)=2V_0(1-r_0/r) \quad (3).$$

This potential can be produced by employing, e.g., substantially concentric substantially hemispherical electrodes of radii $r_{in}$ and $r_{out}$ with, respectively, potentials $V_{in}$ and $V_{out}$ applied where $r_{in}<r_{out}$ and where, $$V_{in}=2V_0(1-r_0/r_{in}) \quad (4)$$

$$V_{out}=2V_0(1-r_0/r_{out}) \quad (5)$$

Analysis of the motion of particles in a central force field can be simplified by choosing the arbitrary reference potential as zero as the distance from the center of force, r, goes to infinity. This corresponds to shifting the reference potential as given by equation (3) by $-2V_0$ so that the ions originate from a source at potential $-V_0$ and the nominal total energy of the ions is $-V_0$ at the entrance to the condenser. Ions with $E=-V_0$ and $r=r_0$, (where $r_0$ 108 is the radius of the central trajectory of the ion condenser) substantially follow the nominal trajectory 110, and the kinetic energy of the ions can be given by, $$T(r_0)=-V_0+2V_0=V_0 \quad (6);$$

and the potential energy as a function of r can be given by, $$V(r)=2V_0(1-r_0/r)-2V_0 \quad (7)$$

The general solution to problems of the form where the potential energy is inversely proportional to the distance from the center of force (e.g., the Kepler problem,) can be given by, $$l/r=(mk/l^2)\{1+[1+(2El^2/mk^2)]^{1/2}\cos(\vartheta-\vartheta')\} \quad (8),$$

where $k=2V_0r_0$, and $\vartheta'$ represents a constant of integration orienting the orbit to the coordinate system.

The general equation for a conic section with one focus at the origin can be given by, $$l/r=C[1+\epsilon\cos(\vartheta-\vartheta')] \quad (9),$$

where $\epsilon$ represents the eccentricity of the conic section, and C is a coefficient dependent, e.g., on the total ion energy. Comparing equations (8) and (9) it follows that the orbit is a conic section with an eccentricity that can be given by, $$\epsilon=[1+(2El^2/mk^2)]^{1/2} \quad (10).$$

The nature of the orbits in the central force field depends on the magnitude of the eccentricity, $\epsilon$, according to the following scheme:

$\epsilon>1$, $E>0$: hyperbola
$\epsilon>1$, $E=0$: parabola
$\epsilon<1$, $E<0$: ellipse
$\epsilon=0$, $E=-mk^2/2l^2$: circle For the cases of interest to ion condensers of the present teachings, the eccentricity, $\epsilon$, is always less than one; as a result, the possible orbits are circles or ellipses.

At a turning point of an ellipse the radial velocity, dr/dt, is zero; thus $\vartheta=\vartheta'$ corresponds to a turning point. If we set $\vartheta'$ to zero then the turning points occur at $\vartheta=0$, and $\pi$. With a turning point of the orbit at $\vartheta=0$, the square of the angular momentum can be given by, $$l^2=2mT_ir_i^2 \quad (11),$$

where $r_i$ is the radial distance at $\vartheta=0$, and the initial kinetic energy, $T_i$, can be given by, $$T_i=E-V(r_i) \quad (12).$$

Where the initial conditions are $r_i=r_0$, $E=-V_0$, and $\vartheta=0$, the resultant orbit is a circle. All other initial conditions correspond to elliptical orbits.

For example, one interesting case is where ions enter the ion condenser at the same radial position, e.g., $r_i=r_0$ and $\vartheta=0$, but with a total energy, E, higher than or lower than $-V_0$. These ions can experience elliptical trajectories (orbits) in the ion condenser. FIG. 1B illustrates an example of the trajectories of ions that each enter the attractive field at $r=r_0$ corresponding to a turning point of the orbit, but with different total energies. The middle trajectory 122 representing an ion with $E=-V_0$, the upper trajectory 124 representing an ion with $E=-V_0+0.1\ V_0$, and the lower trajectory 126 representing an ion with $E=-V_0-0.1\ V_0$. For the ion at the higher energy ($E=-V_0+0.1\ V_0$), the coefficient C can be given by, $$C^{-1}=l^2/mk=r_0(1+\delta V/V_0)=1.1\ r_0 \quad (13).$$

For the ion at the lower energy ($E=-V_0-0.1\ V_0$), the coefficient C can be given by, $$C^{-1}=l^2/mk=r_0(1-\delta V/V_0)=0.9\ r_0 \quad (14).$$

In both cases the eccentricity of the orbit given by evaluating equation (10) can be expressed as $\delta V/V_0$. Inserting these values into the orbital equation (8) and evaluating at the opposite turning point, $\vartheta=\pi$, the exit distances $r_1$ 128 and $r_2$ 130 for, respectively, the low energy ion trajectory 126 and the high energy ion trajectory 124 (where the radial reference arrows have been displaced for clarity in FIG. 1B) can be given by:

$$r_1(\text{low energy})=r_0(1-\delta V/V_0)/(1+\delta V/V_0)=0.818\ r_0 \quad (15);$$

and $$r_2(\text{high energy})=r_0(1+\delta V/V_0)/(1-\delta V/V_0)=1.222\ r_0 \quad (16).$$

The radial displacement of the exit distance of the lower energy ions $r_1$ 128 and higher energy ions 130 from the center of force with respect to their entrance distances illustrates, respectively, energy dispersion of the lower and higher energy ions by the ion condenser.

The semimajor axis, a, of an orbit is one-half the sum of the two apsidal distances, for example, $$\text{for } E=-V_0;\ 2a=2r_0 \quad (17);$$

$$\text{for } E=-V_0+\delta V;\ 2a=r_0+r_0(1+\delta V/V_0)/(1-\delta V/V_0)=2r_0/(1-\delta V/V_0) \quad (18);$$

$$\text{for } E=-V_0-\delta V;\ 2a=r_0+r_0(1-\delta V/V_0)/(1+\delta V/V_0)=2r_0/(1+\delta V/V_0) \quad (19);$$

Accordingly, where $\delta V/V_0=0.1$, equation (18) yields, $$a(\text{low energy})=r_0/1.1=0.9\ r_0 \quad (20);$$

and equation (19) yields, $$a(\text{high energy})=r_0/0.9,=1.1\ r_0 \quad (21).$$

Another case of interest corresponds to a parallel beam of finite diameter entering the condenser where each ion has a total energy of $E=-V_0$. Referring to FIG. 1C, an ion beam 142 with a diameter 144 of $2\ \delta r/r_0$ at the turning point of the orbit at $\vartheta=0$ is illustrated. For ions that enter the ion condenser at the initial position $r_i=r_0(1+\delta r/r_0)$, the square of the angular momentum can be given by, $$l^2=2m\ T_ir_i^2=2m\ V_0[1-(\delta r/r_0)^2]r_0^2 \quad (22);$$

and the initial kinetic energy, $T_1$, can be given by, $$T_i=E-V(r_i)=-V_0+2\ V_0r_0/r_i=V_0(2/(1+\delta r/r_0)-1=V_0(1-\delta r/r_0)/(1+\delta r/r_0) \quad (23).$$

For ions that enter the ion condenser at the initial position $r_i=r_0(1-\delta r/r_0)$, the initial kinetic energy, $T_i$, can be given by, $$T_i=V_0(1+\delta r/r_0)/(1-\delta r/r_0) \quad (24);$$

and the angular momentum for this orbit is also given by equation (19). Substituting into equation (10) the eccentricity of these orbits can be given by;

$$\begin{aligned}\varepsilon &= [1+(2El^2/mk^2)]^{1/2} \quad (25)\\ &= \{1-2V_0(2mV_0)[1-(\delta r/r_0)^2]r_0^2/m(2V_0r_0)^2\}^{1/2}\\ &= \{1+[1-[1-(\delta r/r_0)^2]\}^{1/2}=\delta r/r_0;\end{aligned}$$

and the coefficient C can be given by, $$C^{-1}=r_0[1-(\delta r/r_0)^2] \quad (26).$$

Inserting these values into the orbital equation (8) and evaluating at the opposite turning point, $\vartheta=\pi$, the exit distances $r_1$ and $r_2$ for, respectively, the ions initially on the inner edge of the ion beam 145 ($r_i=r_0(1-\delta r/r_0)$, and ion trajectory 146) and ions initially on the outer edge of the ion beam 147 ($r_i=r_0(1+\delta r/r_0)$, and ion trajectory 148) can be given by, $$r_1=r_0(1+\delta r/r_0),\ a=r_0 \quad (27);$$

$$r_2=r_0(1-\delta r/r_0),\ a=r_0 \quad (28);$$

and where at $\vartheta=\pi/2$, $$r=C^{-1}=r_0[1-(\delta r/r_0)^2] \quad (29),$$

for both orbits. The exit distances $r_1$ 150 and $r_2$ 152 are illustrated in FIG. 1C, where the radial reference arrows have been displaced for clarity. Equations (27)-(29) illustrate that to first order, parallel orbits of the same energy entering the hemispherical ion condenser are focused at 90 degrees and emerge from the condenser as parallel orbits with no change in the diameter of the beam.

Two Ion Condensers in Series

Figure 2A:
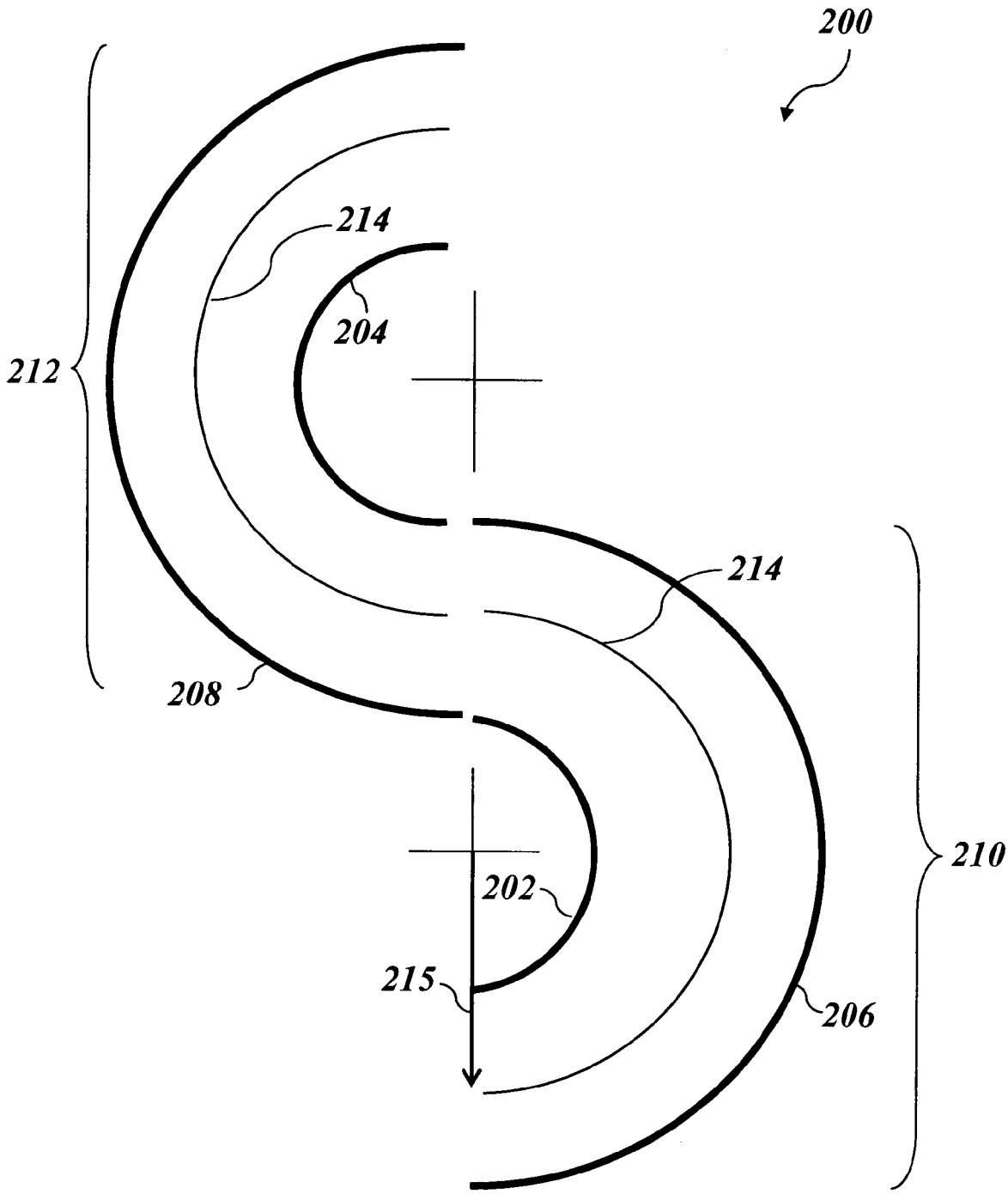
FIG. 2A schematically depicts two spherical ion condensers and the representative nominal ion trajectory for ions that enter at $r_0$.
Figure 2B:
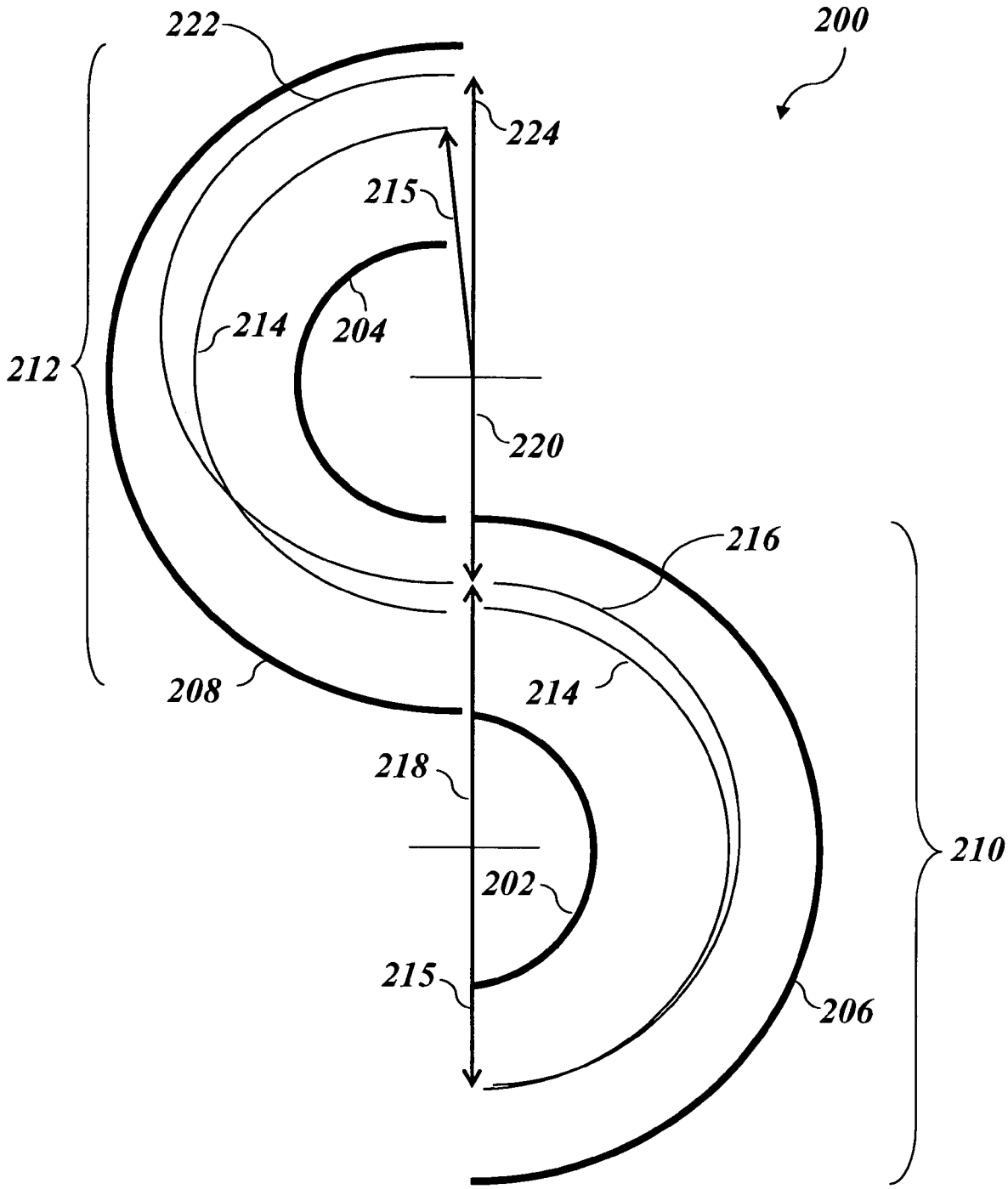
FIG. 2B schematically depicts the ion trajectories of ions with two different kinetic energies in the ion condenser of FIG. 2A.

To better understand the present teachings, an example of the behavior of ions in two 180 degree spherical ion condensers arranged in series 200 is schematically illustrated in FIGS. 2A-2B. Referring to FIG. 2A, each ion condenser employs a static electrical field and comprises an inner hemispherical electrode 202, 204 and an outer hemispherical electrode 206, 208. In this illustration, the electrical potential on the inner electrode 202 of the first ion condenser 210 equals that on the inner electrode 204 of the second ion condenser 212; and the electrical potential on the outer electrode 206 of the first ion condenser 210 equals that on outer electrode 208 of the second ion condenser 212. Ions entering the ion condensers 200 with $E=-V_0$ and $r=r_0$, follow the nominal trajectory 214 for (where $r_0$ 215 is the radius of the central trajectory of the ion condenser). The energy dependence of the ion trajectories through the first ion condenser (or first sector) 210 can be illustrated and described by reference, e.g., to FIG. 1B and equations (13)-(21).

For example, Referring to FIG. 2B, a higher energy ion that enters the first sector 210 at the nominal radial distance $r_0$ 215 follows a trajectory 216 different from the nominal trajectory 214 and exits the first sector at a radial distance $r_{21}$ 218 corresponding to $r_2$ in equation (16). In the configuration illustrated in FIG. 2B, this ion then enters the second sector 212 at a smaller radial distance, $2r_0-r_{21}$, 220 follows a trajectory 222 different from the nominal trajectory 214 in the second sector 212 and exits at a larger radial distance $r_{22}$, 224.

For the higher energy trajectory with energy $E=-V_0(1-\delta V/V_0)$ the radial distance at the entrance to the second condenser can be given by, $$r_{12}=2r_0-r_{21}=r_0(1-3\delta V/V_0)/(1-\delta V/V_0) \quad (30),$$

and the coefficient C and eccentricity $\epsilon$ for this case can be given, respectively, by $$C^{-1}=r_0[1-(3\delta V/V_0)^2][1-(\delta V/V_0)] \quad (31);$$

and $$\epsilon=3\delta V/V_0 \quad (32).$$

Substituting these values into the orbital equation (8) yields for the radial distance at the exit, $r_{22}$, and the semimajor axis, a, respectively, $$r_{22}=r_0(1+3\delta V/V_0)/(1-\delta V/V_0) \quad (33);$$

and $$a=(r_{12}+r_{22})/2=r_0/[1-(\delta V/V_0)] \quad (34).$$

This result for the semimajor axis, a, is the same as for the first condenser and is consistent with the general conclusion that the semimajor axis of an elliptical orbit depends only on the energy and the eccentricity is determined by the angular momentum.

In this analysis entrance of parallel beam at a turning point of the ellipse has been discussed explicitly. Since the elliptical orbit is determined by the energy and angular momentum, orbits with different entrance conditions; e.g., entrance an angle relative to the nominal ion beam axis, implies a different value for $\vartheta'$ in equation (8) and for a given energy and angular momentum corresponds to a rotation of the orbit relative to that for $\vartheta'=0$.

Ion Optics Systems

A wide variety of ion condensers can be employed in the ion optics systems of the present teachings including, but not limited to, spherical, cylindrical and toroidal ion condensers. It is to be understood that the ion condensers in the figures are illustrated schematically. For example, ion condensers typically comprise multiple elements for establishing the electrical fields therein, and can contain guard electrodes to prevent stray electrical fields from entering field-free regions. Further, it is to be understood that although various electrical potentials are noted as zero or ground, this is purely for convenience of notation and conciseness in the equations appearing herein. One of skill in the art will readily recognize that it is not necessary to the present teachings that the potential at an electrode be at a true earth ground electrical potential. For example, the potential at the electrode can be a "floating ground" with an electrical potential significantly above (or below) true earth ground (e.g., by thousands of volts or more). Accordingly, the description of an electrical potential as zero or as ground herein should not be construed to limit the value of an electrical potential with respect to earth ground in any way.

The present teachings provide ion optics systems comprising four or more ion condensers where the deflection angle, $\theta$, for each ion condenser is less than or equal to about $\pi$ radians. The ion condensers can comprise, for example, one or more of a spherical ion condenser, a cylindrical ion condenser, and a toroidal ion condenser. In various embodiments, the deflection angle about equal to ($\pi/h$) radians, which can be written as, $$\theta\approx(\pi/h)\ \text{radians}=(180/h)\ \textit{degrees} \quad (35),$$

where $$h=(2-c)^{1/2} \quad (36),$$

and $$c=r_0/\rho_0 \quad (37).$$

where $r_0$ is the radius of the central circular trajectory of the ion condenser and $\rho_0$ is the axial radius of the central equipotential surface. For a spherical ion condenser, c=1, h=1; for a cylindrical ion condenser c=0, $h=2^{1/2}$; and for a toroidal ion condenser the value of c is between 0 and 1. Accordingly, in various embodiments, an ion optics system of the present teachings can comprise, for example,: four spherical ion condensers each with a deflection angle of about 180 degrees; four cylindrical ion condensers each with a deflection angle of about 127.2 degrees; four toroidal ion condensers each with a deflection angle between about 127.2 degrees and about 180 degrees; etc.

The flight time of an ion using an ion optics system of the present teachings can be estimated from the following principles. The flight time of an ion through an ion condenser, $\tau_{1C}$, can be given (to first order in the energy spread of the ion) by, $$\tau_{1C}=(\theta r_0/v_0)[1+(2\delta V/V_0)(1/h^2-1/4)+\ldots] \quad (38),$$

where $v_0=(2V_0/m)^{1/2}$ is the velocity of an ion of mass m with kinetic energy $V_0$.

In various embodiments, the condition for first order time focusing in a time-of-flight analyzer using an ion condenser with a deflection angle of about ($\pi$/h) radians, in series with an electrical field free region (e.g., an electrical field free flight tube), can be given as, $$d_{ff}=4\theta r_0(1/h^2-1/4) \quad (39),$$

where $d_{ff}$ is the field-free drift length for first order time focusing. The flight time, $t_{ff}$, for ions traveling in an electrical field free region of path length d can be given by, $$t_{ff}=d_{ff}/v \quad (40),$$

and the total flight time, t, through one ion condenser and the electrical field free region to the first order time focus ($d=d_{ff}$) can be given by, $$t=t_{ff}+\tau_{1C} \quad (41).$$

In various aspects, the present teachings provide an ion optics system comprising two or more of pairs of ion condensers where the members of each pair of ion condensers are disposed on opposite sides of a first plane such that the first member of a pair of ion condensers has a position that is substantially mirror-symmetric about the first plane relative to the position of the second member of the pair. The ion condensers are positioned relative to each other to substantially compensate for the energy dispersion inherent to a single ion condenser. As a result, in various embodiments, lower energy ion and higher energy ion trajectories exiting the ion optics system exhibit substantially no spatial dispersion due to differences in the ion kinetic energy.

In various aspects, the present teachings provide an ion optics system comprising two or more of pairs of spherical, cylindrical, and/or toroidal ion condensers where the members of each pair of ion condensers are disposed on opposite sides of a first plane such that the first member of a pair of ion condensers has a position that is substantially mirror-symmetric about the first plane relative to the position of the second member of the pair; where the ion condensers are positioned relative to each other to substantially compensate for the energy dispersion inherent to a single ion condenser; and where the deflection angle, $\theta$, for each ion condenser is less than or equal to about $\pi$ radians. As a result, in various embodiments, lower energy ion and higher energy ion trajectories exiting the last ion condenser exhibit substantially no spatial dispersion due to differences in ion kinetic energy. The ion optic systems of the present teachings can include, for example, one or more ion-focusing elements (e.g., an einzel lens), and ion-steering elements (e.g., deflector plates), for example, to provide a substantially parallel input ion beam.

In various embodiments, ion optics systems of the present teachings comprising two or more pairs ion condensers each with a deflection angle, $\theta$, less than or equal to about $\pi$ radians, can provide a substantially parallel output ion beam with no magnification, for a parallel input ion beam, where the transit time through the condenser is independent of the displacement of an entering trajectory from the nominal axis.

In various embodiments, an ion optics system according to the present teachings comprising spherical, cylindrical, and/or toroidal ion condensers can be configured to provide radial ion focusing, e.g., ions which enter the ion optics system with different incoming original lateral displacements in the plane of the orbit can be focused so that the outgoing lateral displacement is substantially equal to the incoming original lateral displacement.

In various embodiments, the present teachings provide an ion optics system comprising four ion condensers where the first ion condenser and the second ion condenser are disposed on opposite sides of a first plane such that the first ion condenser has a position that is substantially mirror-symmetric about the first plane relative to the position of the second ion condenser, e.g., such that the orbits in the second ion condenser are substantially the reflection orbits in the first ion condenser; where the third ion condenser and the fourth ion condenser are disposed on opposite sides of the first plane such that the third ion condenser has a position that is substantially mirror-symmetric about the first plane relative to the position of the fourth ion condenser, e.g., such that the orbits in the third ion condenser are substantially the reflection orbits in the fourth ion condenser; and where the deflection angle, $\theta$, for each ion condenser is less than or equal to about $\pi$ radians.

In various embodiments, an ion optics system can be formed from spherical ion condensers where the deflection angle, $\theta$, for each is about $\pi$ radians. For example, referring to FIG. 3, in various embodiments, an ion optics system 300 comprises four substantially spherical ion condensers each having a deflection angle ($\theta$) of about 180°. The first substantially spherical ion condenser 302 and a second substantially spherical ion condenser 304 are disposed on opposite sides of a first plane 306 (illustrated as the line-of-intersection of the first plane with the plane of the page of the respective Figure) in a substantially mirror-symmetric relationship; and a third substantially spherical ion condenser 308 and a fourth substantially spherical ion condenser 310 are disposed on opposite sides of the first plane 306 in a substantially mirror-symmetric relationship. Also illustrated is the nominal ion trajectory 312 for an ion with kinetic energy $V_0$entering the condenser at initial radius $r_0$ with the electrical potential $V_{in}=2V_0(1-r_0/r_{in})$ applied to the inner condenser electrodes 314 of radius $r_{in}$, and with the electrical potential $V_{out}=2V_0(1-r_0/r_{out})$ applied to the outer condenser electrodes 316 of radius $r_{out}$.

Figure 3:
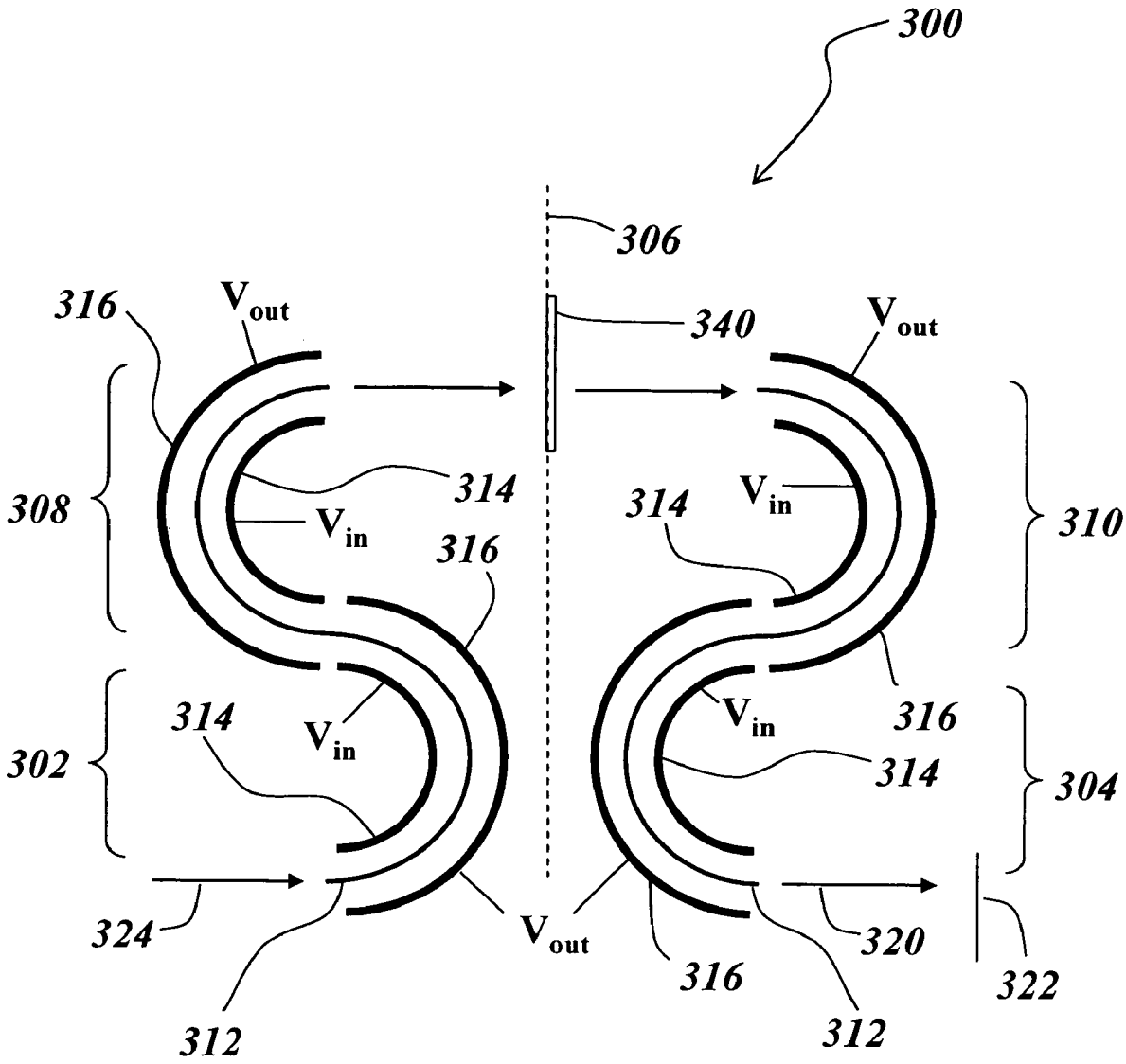
FIG. 3 schematically depicts an ion optics system comprising four symmetrically arranged substantially spherical ion condensers where an ion trajectory exiting the ion optics system is substantially parallel to the corresponding ion trajectory entering the ion optics system.

In various embodiments, a trajectory 320 of an ion exiting the ion optics system can be provided that intersects a surface substantially parallel to a focal surface 322 (e.g., a focal plane) at a position that is substantially independent of the ion kinetic energy (e.g., on entering the first cylindrical ion condenser 302). In various embodiments, the ion condensers are arranged such that a trajectory of ions exiting 320 the ion optics system is substantially parallel to a trajectory of said ions entering 324 the ion optics system. As illustrated in FIG. 3, the trajectory of ions exiting 320 the ion optics system is also substantially coincident with trajectory of said ions entering 324 the ion optics system.

The orbital period in a hemisphere, $\tau_{hemi}$, (e.g., a spherical ion condenser with a 180 degree deflection angle) can be found, e.g., from equation (38); the period in a hemisphere can be given by, $$\tau_{hemi}=\pi r_0(m/2V_0)^{1/2}(1-\delta V/V_0)^{-3/2} \quad (42),$$

or $$\tau_{hemi}=(\pi r_0/v_0)[1+(3/2)(\delta V/V_0)+(15/8)(\delta V/V_0)^2+\ldots] \quad (43),$$

where $v_0=(2V_0/m)^{1/2}$ is the velocity of an ion of mass m with kinetic energy $V_0$. The result of equation (43) is in agreement (to first order) with the more approximate result for the case h=1 in equation (38).

The flight time, $t_{ff}$, for ions traveling in an electrical field free region of path length d can be given by, $$t_{ff} = d_{ff}/v \quad (44)$$
$$= (d/v_0)(1+\delta V/V_0)^{-1/2}$$
$$= (d/v_0)[1-(1/2)(\delta V/V_0)+(3/8)(\delta V/V_0)^2+\ldots].$$

In various embodiments, the condition for first order time focusing in a time-of-flight analyzer using a spherical ion condenser with π radians, in series with an electrical field free region (e.g., an electrical field free flight tube), can be given as, $$d_{ff}=3\pi r_0 \quad (45).$$

The total flight time through one spherical ion condenser and the electrical field free region to the first order time focus can be given by, $$t=t_{ff}+\tau_{hemi}=(4\pi r_0/v_0)[1+3(\delta V/V_0)^2+\ldots] \quad (46).$$

In addition to energy dispersion compensation, in various embodiments, the ion optics systems of the present teachings comprising spherical ion condensers focus ions in a direction perpendicular to the nominal orbital plane. Accordingly, ions entering above or below this plane follow an elliptical orbit determined by the angular momentum and energy, but the plane of the orbit is tipped relative to the nominal orbital plane. The orbits intersect, to first order, at $\vartheta$=90 degrees so that an ion entering a distance δz above the nominal orbital plane (e.g., the plane of the page in FIG. 3) exits at −δz.

In various embodiments, an ion optics system can be formed from right circular cylinders where the deflection angle, θ, for each is about $\pi/2^{1/2}$ radians. For example, referring to FIG. 4, in various embodiments, an ion optics system 400 comprises four cylindrical ion condensers each having a deflection angle (θ) of about 127.2°. The first cylindrical ion condenser 402 and a second cylindrical ion condenser 404 are disposed on opposite sides of a first plane 406 (illustrated as the line-of-intersection of the first plane with the plane of the page of the respective figure) in a substantially mirror-symmetric relationship; and a third cylindrical ion condenser 408 and a fourth cylindrical ion condenser 410 are disposed on opposite sides of the first plane 406 in a substantially mirror-symmetric relationship. Also illustrated is the nominal ion trajectory 412 for an ion with kinetic energy $V_0$ entering the condenser at initial radius $r_0$ with the electrical potential $V_{in}=2V_0\ln(r_{in}/r_0)$ applied to the inner condenser electrodes 414 of radius $r_{in}$, and with the electrical potential $V_{out}=2V_0\ln(r_{out}/r_0)$ applied to the outer condenser electrodes 416 of radius $r_{out}$.

Figure 4:
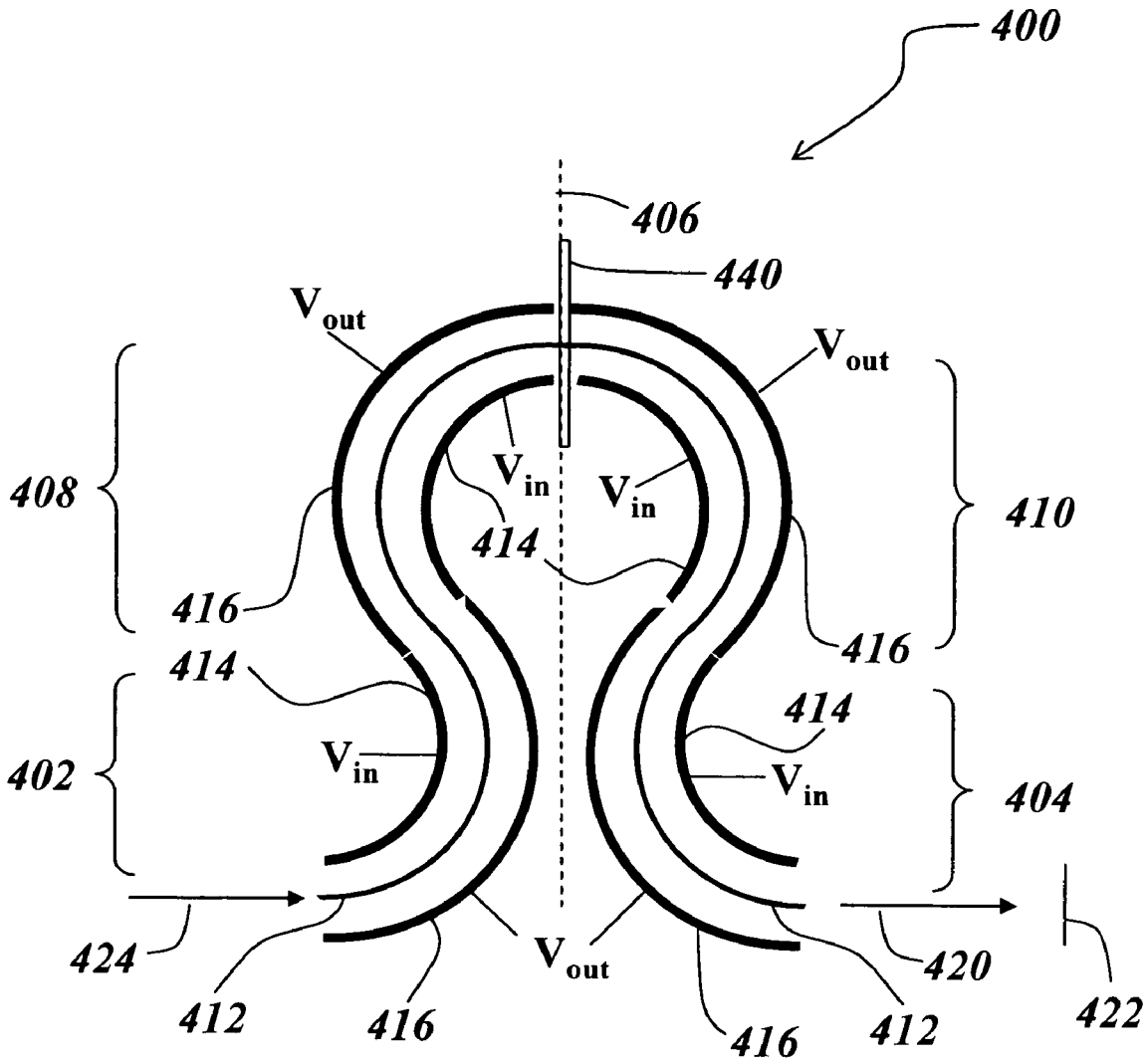
FIG. 4 schematically depicts an ion optics system comprising four symmetrically arranged cylindrical ion condensers where an ion trajectory exiting the ion optics system is substantially parallel to the corresponding ion trajectory entering the ion optics system.

In various embodiments, a trajectory 420 of an ion exiting the ion optics system can be provided that intersects a surface substantially parallel to a focal surface 422 (e.g., a focal plane) at a position that is substantially independent of the ion kinetic energy (e.g., on entering the first cylindrical ion condenser 402). In various embodiments, the ion condensers are arranged such that a trajectory of ions exiting 420 the ion optics system is substantially parallel to a trajectory of said ions entering 424 the ion optics system. As illustrated in FIG. 4, the trajectory of ions exiting 420 the ion optics system is also substantially coincident with trajectory of said ions entering 424 the ion optics system.

The orbital period through a cylindrical condenser with a deflection angle of $\pi/2^{1/2}$ radians can be given by, $$\tau_{cyl}=(\pi/2^{1/2})r_0(m/2V_0)^{1/2}(1-\delta V/V_0)^{-1/2} \quad (47),$$

or $$\tau^{cyl}=(\pi r_0/2^{1/2}v_0)[1+(1/2)(\delta V/V_0)+(3/8)(\delta V/V_0)^2+\ldots] \quad (48).$$

In various embodiments, the condition for first order time focusing in a time-of-flight analyzer using a cylindrical ion condenser with $\theta=\pi/2^{1/2}$ radians, in series with an electrical field free region (e.g., an electrical field free flight tube), can be given as, $$d_{ff}=(\pi/2^{1/2})r_0 \quad (49).$$

The total flight time through one cylidrical ion condenser and the electrical field free region to the first order time focus can be given by, $$t=(2^{1/2}\pi r_0/v_0)[1+(1/4)(\delta V/V_0)^2+\ldots] \quad (50).$$

In addition to energy dispersion compensation, in various embodiments, the ion optics systems of the present teachings comprising cylindrical ion condensers focus ions in the plane perpendicular to the electrodes, but there is substantially no focusing in the orthogonal direction.

In various embodiments, an ion optics system can be formed from toroidal ion condensers where the deflection angle, θ, for each which is greater than or equal to about $\pi/2^{1/2}$ radians and less than or equal to about π radians. A cylindrical condenser terminated by end plates with an appropriate bias voltage applied can be used to form toroidal electric fields for a toroidal ion condenser. Examples of forming toroidal fields and toroidal ion condensers are described by Matsuda et al., *Review of Scientific Instruments*, vol. 32, p. 850, (1961) and by W. P. Poschenrieder, *International Journal of Mass Spectrometry and Ion Physics,* vol. 9, p. 357 (1972), the entire contents of both of which are hereby incorporated by reference.

In various embodiments, an ion selector can be positioned between two ion condensers of an ion optics system to prevent, for example, the transmission of ions with select kinetic energies from the third ion condenser to the fourth ion condenser. Such placement can take advantage of the energy dispersion of trajectories between the two ion condensers. Suitable ion selectors include any structure that can prevent the transmission of ions between the ion condensers based on ion position. Examples of suitable ion selectors include, but are not limited to, ion deflectors, and structures containing one or more openings (e.g., a slit, aperture, etc.). The openings can be constant or variable. Examples of suitable structures containing one or more openings include, but are not limited to, apertured plates, shutters, and choppers (e.g., rotary choppers). In some embodiments, the ion selector is positioned in a symmetry plane passing between the two ion condensers.

For example, referring to FIGS. 3 and 4, in various embodiments, an ion selector 340, 440 can be positioned between the third ion condenser 308, 408 and the fourth ion condenser 310, 410 to provide, for example, an ion optics system with an energy filter, which can use the energy dispersion out of the third ion condenser to select ions yet still provide an outgoing ion trajectory that exhibits substantially no energy dispersion. For example, if a plate with small aperture or slit is placed in the first plane 306, 406 then only ions within a narrow range of kinetic energies will be transmitted to the fourth ion condenser.

Mass Analyzer Systems

In various aspects, the present teachings provide mass analyzer systems comprising an ion optics system and a mass analyzer (e.g., one or more of a time-of-flight, ion trap, quadrupole, RF multipole, and ion mobility spectrometer). The ion optics system of the mass analyzer system can comprise any of the ion optics systems of the present teachings. For example, in various embodiments, the ion optics system comprises two or more pairs of ion condensers where: the members of each pair of ion condensers are disposed on opposite sides of a first plane such that the first member of a pair of ion condensers has a position that is substantially mirror-symmetric about the first plane relative to the position of the second member of the pair; and where the deflection angle, $\theta$, for each ion condenser is less than or equal to about $\pi$ radians. In various embodiments, the ion condensers are arranged such that a trajectory of an ion exiting the ion optics system can be provided that intersects a surface substantially parallel to a focal surface of the ion optics system at a position that is substantially independent of ion kinetic energy. The mass analyzer can comprise, e.g., at least one of a time-of-flight, ion trap, quadrupole, RF multipole, and ion mobility spectrometer.

In various embodiments, an ion optics system can be disposed in the field free-region of a mass spectrometer to provide an ion beam with substantially no energy dispersion. For example, adding any of the ion optics system configurations illustrated in FIGS. 3-4 into a field-free region of a TOF-TOF mass analyzer can provide a TOF-TOF mass analyzer system.

In various embodiments, a mass analyzer system of the present teachings can further comprise one or more of an ion source, ion selector, ion fragmentor, and ion detector. The mass analyzer systems can further comprise one or more ion guides (e.g., RF multipole guide, guide wire), ion mirrors, ion-focusing elements (e.g., an einzel lens), and ion-steering elements (e.g., deflector plates). In various embodiments, the mass analyzer systems the present teaching can provide include, but are not limited to: a first time-of-flight (TOF) mass selector for a tandem TOF-TOF mass spectrometer system; and a TOF-TOF mass spectrometer system.

In various embodiments, a mass analyzer system comprises an ion source, an ion optics system, an ion detector, and one or more mass analyzers (e.g., one or more: substantially electrical field free regions which can serve as a time-of-flight, ion traps, quadrupoles, RF multipoles, and ion mobility spectrometers). For example, adding a pulsed ion source, an ion detector, and a mass analyzer (e.g., an electrical field free region) to any of the configurations illustrated in FIGS. 3-4 can provide a TOF mass analyzer system. Suitable ion sources include, but are not limited to, electron impact (EI) ionization, electrospray ionization (ESI), and matrix-assisted laser desorption ionization (MALDI) sources. Suitable ion detectors include, but are not limited to, electron multiplies, channeltrons, microchannel plates (MCP), and charge coupled devices (CCD).

Figure 5:
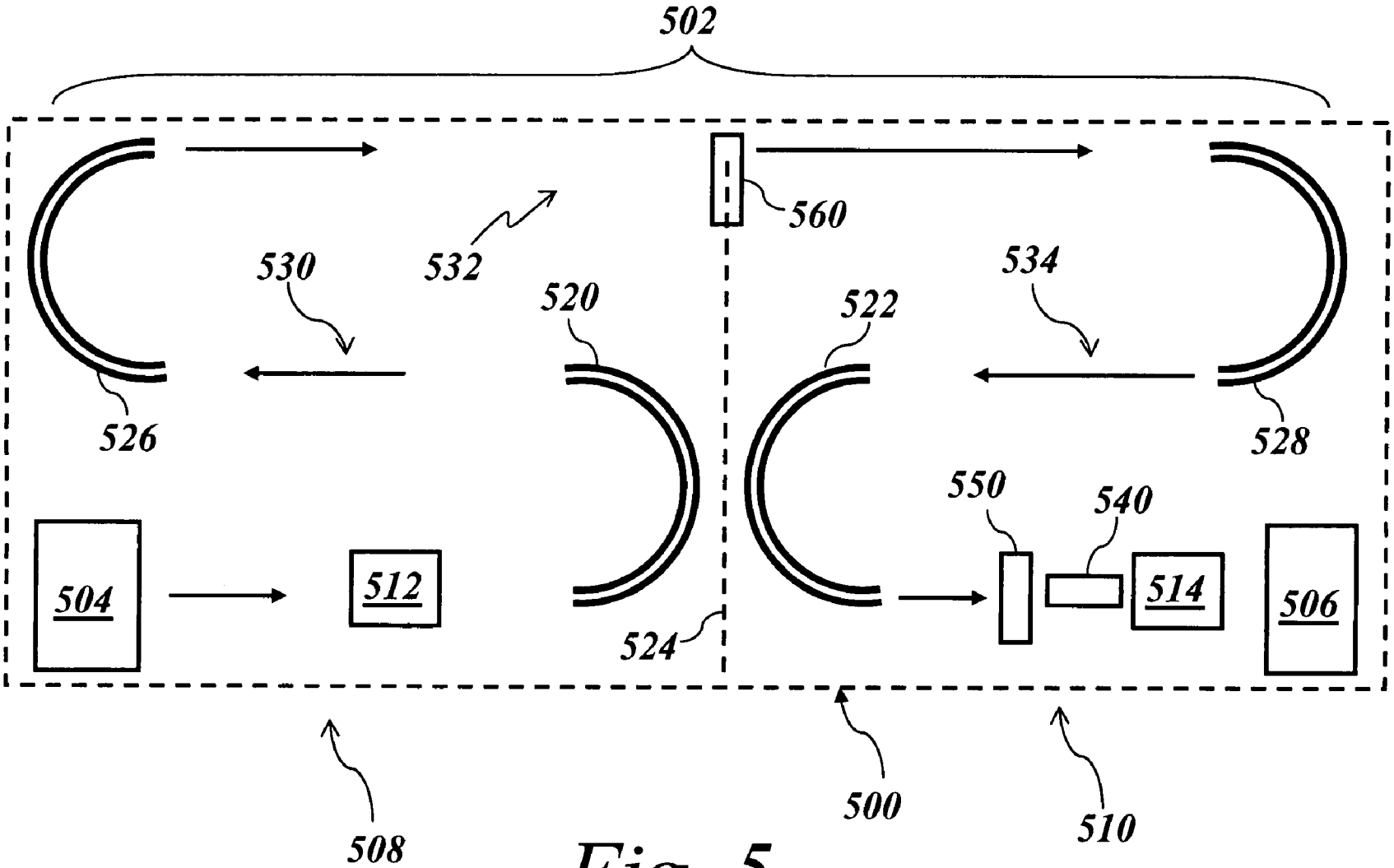
FIG. 5 schematically depicts a mass analyzer system comprising an ion optics system comprising four symmetrically arranged ion condensers.

FIG. 5 schematically depicts various embodiments of a mass analyzer system based on one or more configurations of FIG. 3. Referring to FIG. 5, in various embodiments, a mass analyzer system 500 comprises an ion optics system 502 positioned to receive at least a portion of a pulse of ions provided by an ion source 504, an ion detector 506, and one or more mass analyzers positioned in one or more of: the region 508 between the ion source 504 and the ion optics system 502, the region 510 between the ion detector 506 and the ion optics system 502, or both. The mass analyzer(s) 512, 514 can be, e.g., a substantially electrical field free region that can serve as a time-of-flight mass analyzer, an ion trap, a quadrupole, a RF multipole, an ion mobility spectrometer, or combinations thereof. In various embodiments, a mass analyzer system can be provided by placing an ion optics system in a substantially electrical field free region of a TOF mass spectrometer, the resulting substantially electrical field free region on either side of the ion optics system (e.g., in various embodiments, regions 508 and 510) providing TOF mass analyzers.

In various embodiments, the ion optics system 502 comprises a first ion condenser 520 and the second ion condenser 522 disposed on opposite sides of a first plane 524 such that the first ion condenser 520 has a position that is substantially mirror-symmetric about the first plane 524 relative to that of the second ion condenser 522, a third ion condenser 526 and the fourth ion condenser 528 are disposed on opposite sides of the first plane 524 such that the third ion condenser 526 has a position that is substantially mirror-symmetric about the first plane 524 relative to the position of the fourth ion condenser 528. In FIG. 5, substantially spherical ion condensers, each with a deflection angle, $\theta$, of about $\pi$ radians, are illustrated. In various embodiments, one or more substantially electrical field free regions 530, 532, 534 can be positioned between two or more of the ion condensers. In various embodiments, the mass analyzer systems employ ion-focusing elements (e.g., an einzel lens), ion-steering elements, or both, to provide, for example, a substantially parallel input ion beam for the ion optics system, a substantially parallel output ion beam from the ion optics system, or both.

Referring again to FIG. 5, in various embodiments, a mass analyzer system comprises an ion fragmentor 540 positioned between the ion optics system 502 and a mass analyzer 514. In various embodiments of a mass analyzer system, the ion fragmentor 540 is disposed such that the entrance to the ion fragmentor 540 substantially coincides with the image surface (e.g., image plane) of the ion optics system 502. In some embodiments, ion fragmentor 540 is disposed such that the exit of the ion fragmentor substantially coincides with a focal surface (e.g., an object focal surface) of the mass analyzer 514.

In various embodiments, in various embodiments, an ion selector 550 (e.g., a timed-ion selector) is disposed between an ion optics system 502 a mass analyzer (disposed for example in a region 510 between the ion optics system 502 and the ion detector 506). The ion selector 550 is disposed, in some embodiments, such that the location of the ion selector 550 substantially coincides with the image surface (e.g., image plane) of the ion optics system 502. In various embodiments, the trajectory of ions from the ion optics system 502 is substantially coaxial with an axis of the ion selector. In some embodiments, the ion selector is energized to transmit only ions within a selected m/z range. Accordingly, in various embodiments, an ion selector 550 selects a primary ion (from the ions transmitted by the ion optics system 502) for introduction into an ion fragmentor 540, and a mass analyzer 514 is configured to analyze at least a portion of the fragment ions.

Suitable ion fragmentors include, but are not limited to, those operating on the principles of: collision induced dissociation (CID, also referred to as collisionally assisted dissociation (CAD)), photoinduced dissociation (PID), surface induced dissociation (SID), post source decay, or combinations thereof. Examples of suitable ion fragmentors include, but are not limited to, collision cells (in which ions are fragmented by causing them to collide with neutral gas molecules), photodissociation cells (in which ions are fragmented by irradiating them with a beam of photons), and surface dissociation fragmentors (in which ions are fragmented by colliding them with a solid or a liquid surface).

Suitable ion selectors for ion fragmentors, include but are not limited to, timed-ion-selectors.

Referring again to FIG. 5, in various embodiments, one or more ion selectors 560 can be disposed between ion condensers of the ion optics system 502 to select the range of ion kinetic energies transmitted by the ion optics system 502. Accordingly, in various embodiments, an ion optics system 502 with an ion selector (e.g., 560) selects an ion, with a kinetic energy in a selected energy range, and a second ion selector 550 (e.g. a timed-ion selector), disposed between the ion optics system 502 and a mass analyzer 514, selects a primary ion for introduction into an ion fragmentor 540 and the mass analyzer 514, is configured to analyze at least a portion of the fragment ions.

In various embodiments, an ion optics system, a mass analyzer system, or both, of the present teachings comprises an ion selector. For example, in various embodiments, an ion selector is disposed between: the ion optics system and a mass analyzer, two ion condensers of the ion optics system to prevent the transmission of ions with select kinetic energies, or both.

Examples of suitable ion selectors for placement between ion condensers include, but are not limited to, ion deflectors, and structures containing one or more openings (e.g., a slit, aperture, etc.). The openings can be constant or variable. Examples of suitable structures containing one or more openings include, but are not limited to, apertured plates, shutters, and choppers (e.g., rotary choppers).

Although in many applications of TOF mass spectrometry it is generally desired to transmit all of the ions within the energy range produced by the ion source, in some applications only select ranges of ion kinetic energies are of interest. In addition to the ions produced directly in the ion source with differing kinetic energies, there may be ions present with lower kinetic energy due to, for example, loss of energy due to fragmentation of the ion after production in, for example, an ion source accelerating field or a field-free space following the ion source. In various embodiments, these ions can be removed by using an ion selector as an energy filter in an ion optics system of the present teachings.

In various applications of various embodiments comprising an ion selector in ion optics system, it can be desirable to determine the kinetic energy distributions of the ions of differing masses. This can be accomplished, in various embodiments, by placing a narrow slit or aperture between two of the ion condensers where the ion trajectories are spatially dispersed due to differences in kinetic energy such that only ions within a small energy increment are transmitted. For example, by measuring the intensities of the ion signals at the ion detector as a function of the voltage applied to the ion condensers, the energy distributions for all of the ions detected can be measured, with the ions of differing masses arriving at the ion detector at different times.

To better understand the present teachings and uses thereof, the results of, e.g., equations (38)-(41), equations (43)-(46), and equations (48)-(50), may be compared to those for a traditional single-stage ion mirror wherein the flight time through the ion mirror can be given by, $$t_{mirror} = 4d_m / v_0)(1 + \delta V / V_0)^{1/2} \quad (51)$$

$$= (4d_m / v_0)[1 + (1/2)(\delta V / V_0) - (1/8)(\delta V / V_0)^2 + \ldots \ ],$$

where $d_m$ represents the path length of the ion mirror. The condition for first order time focusing using an ion mirror in series with an electrical field free region can be given as, $$d_{ff}=4d_m \quad (52).$$

The total flight time through the ion mirror and the electrical field free region to the first order time focus can be given by, $$t=(8d_m/v_0)[1+(1/4)(\delta V/V_0)^2+\ldots] \quad (53).$$

For example, a comparison of the second order coefficients of the flight time estimates can be used to compare the ion optics systems and mass analyzer systems of the present teachings with traditional TOF with a single stage ion mirror.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

The section headings used herein are for organizational purposes only and are not to be construed as limiting the subject matter described in any way.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

The claims should not be read as limited to the described order or elements unless stated to that effect. It should be understood that various changes in form and detail may be made without departing from the scope of the appended claims. By way of example, any of the disclosed features can be combined with any of the other disclosed features to provide an ion optics system or mass analyzer system in accordance with the present teachings. For example, any of the various disclosed embodiments of an ion optics system can be combined with one or more of an ion source, ion selector, ion fragmentor, and ion detector, ion guide, ion-focusing element, ion-steering element, and mass analyzer (e.g., at least one of a time-of-flight, ion trap, quadrupole, RF multipole, and ion mobility spectrometer), to provide a mass analyzer or mass analyzer system in accordance with the present teachings. Therefore, all embodiments that come within the scope and spirit of the following claims and equivalents thereto are claimed.

What is claimed:

1. An ion focusing system for sample analysis comprising:

an ion source for ionizing a sample to form sample ions, a portion of the sample ions having substantially the same mass-to-charge ratio and having a spread of kinetic energies, and an ion optics system in communication with the ion source including:

two or more pairs of ion condensers, each pair of ion condensers comprising a first member and a second member;

the members of each pair of ion condensers disposed on opposite sides of a first plane such that the first member of a pair of ion condensers has a position that is substantially mirror symmetric about the first plane relative to the position of the second member of the pair, and wherein the deflection angle of each of the ion condensers is less than or equal to 180 degrees; and wherein the two or more pairs of ion condensers are arranged such that the portion of sample ions having substantially the same mass-to-charge ratio and having a spread of kinetic energies entering the ion optics system along a first trajectory exit the ion optics system along a second trajectory, the second trajectory being substantially the same for said portion of sample ions, and the second trajectory being substantially parallel to said first trajectory, and further wherein said portion of sample ions having the same mass-to-charge ratio exit the ion optics system along the second trajectory and arrive at an image plane at substantially the same time.

2. The ion focusing system of claim 1, wherein the trajectory of ions exiting the ion optics system is substantially coincident with the trajectory of said ions entering the ion optics system.

3. The ion focusing system of claim 1, further comprising an ion selector disposed between the two of the ion condensers of the ion optics system.

4. The ion epties focusing system of claim 1, wherein the ion condensers each comprise a substantially cylindrical ion condenser with a deflection angle of about 127.2 degrees.

5. The ion focusing system of claim 1, wherein the sample ions include ions of differing mass-to-charge ratios.

6. An ion focusing system comprising:

an ion source for ionizing a sample to form sample ions, a portion of the sample ions having substantially the same mass-to-charge ratio and having different kinetic energies, and an ion optics system in conmiunication with the ion source including:

a first ion condenser;

a second ion condenser, the first ion condenser and the second ion condenser disposed on opposite sides of a first plane such that the first ion condenser has a position that is substantially mirror-symmetric about the first plane relative to the position of the second ion condenser;

a third ion condenser; and a fourth ion condenser, the third ion condenser and the fourth ion condenser disposed on opposite sides of the first plane such that the third ion condenser has a position that is substantially mirror-symmetric about the first plane relative to the position of the fourth ion condenser, wherein the deflection angle of each of the ion condensers is less than or equal to about 180 degrees; and wherein the first ion condenser, the second ion condenser, the third ion condenser and the fourth ion condenser are arranged such that the portion of sample ions having substantially the same mass-to-charge ratio and having different kinetic energies entering the ion optics system along a first trajectory exit the ion optics system along a second trajectory, the second trajectory being substantially the same for all said portion of sample ions, and the second trajectory being substantially parallel to said first trajectory, and further wherein said portion of sample ions having the same mass-to-charge ratio exit the ion optics system along the second trajectory and arrive at an image plane at substantially the same time.

7. The ion epties focusing system of claim 6, wherein the trajectory of ions exiting the ion optics system is substantially coincident with the trajectory of said ions entering the ion optics system.

8. The ion epties focusing system of claim 6, further comprising an ion selector disposed between the two of the ion condensers of the ion optics system.

9. The ion focusing system of claim 6, wherein the ion condensers each comprise a substantially cylindrical ion condenser with a deflection angle of about 127.2 degrees.

10. The ion focusing system of claim 6, wherein the sample ions include ions of differing mass-to-charge ratios.

11. A mass analyzer system comprising:

an ion source for ionizing a sample to form sample ions, a portion of the sample ions having substantially the same mass-to-charge ratio and having a spread of kinetic energies, and an ion optics system, the ion optics system comprising:

two or more pairs of ion condensers, each pair of ion condensers comprising a first member and a second member, the members of each pair of ion condensers disposed on opposite sides of a first plane such that the first member of a pair of ion condensers has a position that is substantially mirror-symmetric about the first plane relative to the position of the second member of the pair, and wherein the deflection angle of each of the ion condensers is less than or equal to about 180 degrees; and wherein the ion condensers are arranged such that ions having a spread of kinetic energies entering the ion optics system along a first trajectory exit the ion optics system along a second trajectory, the second trajectory being substantially the same for all said ions, and the second trajectory being substantially parallel to said first trajectory, and further wherein said portion of sample ions having the same mass-to-charge ratio exit the ion optics system along the second trajectory and arrive at an image plane at substantially the same time and, an ion mass analyzer system, the ion mass analyzer system positioned to receive the portion of sample ions exiting the ion optics system.

12. The mass analyzer system of claim 11, further comprising:

an ion source capable of providing a pulse of ions, the ion optics system positioned to receive at least a portion of a pulse of ions provided by the ion source as the portion of sample ions; and a detector, the detector positioned to detect the portion of sample ions exiting the mass analyzer.

13. The mass analyzer system of claim 11, wherein the mass analyzer comprises one or more of a quadrupole, RF muiltipole, ion trap, time-of-flight (TOF), and combinations thereof.

14. The mass analyzer system of claim 11, comprising one or more of an ion selector and an ion fragmentor positioned between the ion optics system and the mass analyzer.

15. The mass analyzer system of claim 11, wherein the ion condensers of the ion optics system each comprise a substantially cylindrical ion condenser with a deflection angle of about 127.2 degrees.

16. The mass analyzer system of claim 11, further comprising one or more of an ion source, ion selector, ion fragmentor, an ion detector, ion guide, ion-focusing element, ion-steering element, and combinations thereof.

17. The mass analyzer system of claim 11, wherein the entrance port to the ion mass analyzer is located at the image plane.

18. The mass analyzer system of claim 11, wherein the sample ions include ions of differing mass-to-charge ratios.

19. The mass analyzer system of claim 12, wherein the detector is located at the image plane.

* * * * *

UNITED STATES PATENT AND TRADEMARK OFFICE

CERTIFICATE OF CORRECTION

PATENT NO. : 7,439,520 B2
APPLICATION NO. : 11/042191
DATED : October 21, 2008
INVENTOR(S) : Marvin L. Vestal It is certified that error appears in the above-identified patent and that said Letters Patent is hereby corrected as shown below:

Claim 4, col. 19, line 23, delete “epties”;

Claim 7, col. 20, line 1, delete “epties”;

Claim 8, col. 20, line 5, delete “epties”;

Signed and Sealed this

Sixteenth Day of December, 2008

JON W. DUDAS
*Director of the United States Patent and Trademark Office*